US012714173B2

(12) United States Patent
Petre

(10) Patent No.: US 12,714,173 B2
(45) Date of Patent: Aug. 25, 2026

(54) HELMET PAD ASSEMBLY

(71) Applicant: VICIS IP, LLC, New York, NY (US)

(72) Inventor: Tucker Petre, Jacksonville, FL (US)

(73) Assignee: VICIS IP, LLC, New York, NY (US)

( * ) Notice: Subject to any disclaimer, the term of this patent is extended or adjusted under 35 U.S.C. 154(b) by 323 days.

(21) Appl. No.: 18/314,786

(22) Filed: May 9, 2023

(65) Prior Publication Data

US 2023/0354944 A1 Nov. 9, 2023

Related U.S. Application Data

(60) Provisional application No. 63/340,821, filed on May 11, 2022, provisional application No. 63/339,669, filed on May 9, 2022.

(51) Int. Cl.
*A42B 3/12* (2006.01)

(52) U.S. Cl.
CPC ..... *A42B 3/12* (2013.01); *A42B 3/127* (2013.01)

(58) Field of Classification Search
CPC ..... A42B 3/12; A42B 3/127; A42B 3/125; A42B 3/32; A42B 3/324
See application file for complete search history.

(56) References Cited

U.S. PATENT DOCUMENTS

| | | | |
|---|---|---|---|
| 6,871,525 | B2 | 3/2005 | Withnall et al. |
| 8,528,118 | B2 | 9/2013 | Ide et al. |
| D752,822 | S | 3/2016 | Bologna |
| D787,748 | S | 5/2017 | Bologna |
| 9,788,591 | B2 | 10/2017 | Ide et al. |
| 10,136,692 | B2 | 11/2018 | Ide et al. |
| 10,159,296 | B2 | 12/2018 | Pietrzak et al. |
| D844,255 | S | 3/2019 | Bologna |
| 10,271,605 | B2 | 4/2019 | Withnall et al. |
| 10,362,829 | B2 | 7/2019 | Lowe |
| D856,600 | S | 8/2019 | Withnall et al. |
| 10,506,841 | B2 | 12/2019 | Bologna et al. |
| 10,561,193 | B2 | 2/2020 | Withnall et al. |
| 10,780,338 | B1 | 9/2020 | Bologna et al. |
| 10,856,600 | B2 | 12/2020 | Ide et al. |
| 10,932,514 | B2 | 3/2021 | Ide et al. |
| 10,948,898 | B1 | 3/2021 | Pietrzak et al. |
| D916,385 | S | 4/2021 | Withnall et al. |
| D927,084 | S | 8/2021 | Bologna et al. |
| 11,166,511 | B2 | 11/2021 | Infusing et al. |

(Continued)

*Primary Examiner* — Haley A Smith
(74) *Attorney, Agent, or Firm* — Ingrassia Fisher & Lorenz, LLP

(57) ABSTRACT

A helmet can include an outer surface and an inner surface, with an impact mitigation layer disposed between the outer surface and the inner surface. The helmet can include a pad assembly coupled to the inner surface. The pad assembly can include a fit adjustable liner attached to the inner surface of the helmet, and one or more nesting pods. The fit adjustable liner can include a first surface and multiple protrusions extending away from the first surface, with each protrusion defining a raised surface. The nesting pods fit over raised surfaces of the protrusions of the fit adjustable liner. At least one of the nesting pods can include a pod body defining an outer surface and an inner surface, and the inner surface can define a recessed cavity in the pod body. The recessed cavity at least partially surrounds a raised surface of a protrusion of the liner.

25 Claims, 8 Drawing Sheets

(56) References Cited

U.S. PATENT DOCUMENTS

| | | | | |
|---|---|---|---|---|
| 11,167,198 | B2 | 11/2021 | Bologna et al. | |
| 11,213,736 | B2 | 1/2022 | Bologna et al. | |
| 11,291,263 | B2 | 4/2022 | Lowe | |
| 11,311,067 | B2 | 4/2022 | Bologna et al. | |
| 11,399,589 | B2 | 8/2022 | Bologna et al. | |
| 11,419,383 | B2 | 8/2022 | Pietrzak et al. | |
| 11,503,872 | B2 | 11/2022 | Bologna et al. | |
| 11,638,457 | B2 | 5/2023 | Lowe | |
| 11,712,615 | B2 | 8/2023 | Bologna et al. | |
| 2002/0010958 | A1* | 1/2002 | Schiebl | A42B 3/08 2/413 |
| 2010/0186150 | A1* | 7/2010 | Ferrara | A42B 3/121 2/412 |
| 2013/0291289 | A1* | 11/2013 | Szalkowski | A42B 3/12 2/414 |
| 2015/0223546 | A1* | 8/2015 | Cohen | A42B 3/127 2/412 |

* cited by examiner

HELMET PAD ASSEMBLY

CROSS-REFERENCE TO RELATED APPLICATIONS

This application claims the benefit under 35 U.S.C. § 119(e) of U.S. Provisional Application No. 63/340,821, filed on May 11, 2022, and U.S. Provisional Application No. 63/339,669, filed May 9, 2022, the disclosures of which are incorporated by reference herein in their entirety for all purposes.

TECHNICAL FIELD

This disclosure relates to helmets, for example, pad assemblies for helmets adapted for contact sports.

BACKGROUND

Many modern organized sports employ helmets are designed to provide the players with head protection, with the desire to provide adequate protection from traumatic brain injuries (TBI). Since safety is a primary concern, helmets have continually evolved in an attempt to reduce the risk and rate of concussions and/or other repetitive brain injuries, which can potentially end a player's career early and lead to long-term brain damage. This is especially true in American football, where the essential character of the athletic contest involves repeated player contacts, impacts, and tackling.

Helmets are currently used for head protection in football or other sports or dangerous activities (e.g., construction, military). Helmets generally include an outer shell and one or more internal components such as impact absorbing structures, liners, or other cushioning materials, that are provided between the head of a wearer and the inner surface of the helmet's outer shell.

SUMMARY

This disclosure describes impact management assemblies and pad assemblies for helmets.

In some aspects, a helmet includes an outer surface and an inner surface; an impact mitigation layer disposed between the outer surface and the inner surface; and a pad assembly coupled to the inner surface, comprising: a fit adjustable liner attached to the inner surface of the helmet and comprising a first surface and a plurality of protrusions extending away from the first surface, each protrusion in the plurality of protrusions defining a raised surface; and at least one liner pad element configured to fit over at least one raised surface of at least one protrusion of the plurality of protrusions of the fit adjustable liner.

These aspects can include one or more of the following features.

In some embodiments, the plurality of protrusions can include an absorbent material.

In some embodiments, the absorbent material can include at least one of foam or air.

In some embodiments, the at least one liner pad element can include a first nesting pod, wherein the first nesting pod can include a first pod body defining a first, outer surface and a second, inner surface opposite to the first, outer surface; the second, inner surface defines a first recessed cavity in the first pod body and a first recessed surface that is positioned between the first, outer surface and the second, inner surface; and the first recessed cavity configured to at least partially surround a first raised surface of a first protrusion of the plurality of protrusions of the fit adjustable liner.

In some embodiments, the first nesting pod comprises a first flange extending from the first pod body, the first flange at least partially bordering the first pod body and removably coupled to the first surface of the fit adjustable liner.

In some embodiments, the helmet can include a fastener that removably couples the first flange of the first nesting pod to the first surface of the fit adjustable liner.

In some embodiments, the fastener can include at least one of a hook and loop fastener, a snap connector, or a magnetic connector.

In some embodiments, the first pod body can include an absorbent material.

In some embodiments, the first pod body can include a first height; wherein the at least one liner pad element can include a second nesting pod comprising a second pod body defining a third, outer surface and a fourth, inner surface of the second pod body, where the fourth, inner surface defines a second recessed cavity in the second pod body and a recessed surface that is positioned between the third, outer surface and the fourth, inner surface, wherein the second pod body comprises a second height that is greater than the first height.

In some embodiments, a distance between the first recessed surface and the first, outer surface of the first pod body is different from a distance between the second recessed surface and the third, outer surface of the second pod body.

In some embodiments, the second nesting pod is configured to at least partially surround the first raised surface of the first protrusion of the plurality of protrusions of the fit adjustable liner.

In some embodiments, the second nesting pod is configured to at least partially surround a second raised surface of a second protrusion of the plurality of protrusions of the fit adjustable liner.

In some embodiments, the second nesting pod is configured to fit at least partially over the first nesting pod.

In some embodiments, a shape of the second inner surface of the first nesting pod approximates a shape of the first raised surface of the first protrusion.

In some embodiments, the pad assembly can include a plurality of regional pad assemblies, each regional pad assembly coupled to a particular region of the inner surface of the helmet.

In some embodiments, the inner surface comprises a plurality of load distribution plates, and wherein each regional pad assembly is coupled to a respective load distribution plate in the plurality of load distribution plates.

In some embodiments, the plurality of regional pad assemblies are interconnected to each other.

In certain aspects, a pad assembly includes a first layer comprising a first surface and a plurality of protrusions extending away from the first surface, each protrusion in the plurality of protrusions defining a raised surface; and a second layer comprising at least one nesting pod disposed over at least one raised surface of at least one protrusion of the plurality of protrusions.

These aspects can include one or more of the following features.

In some embodiments, the at least one nesting pod can include a first nesting pod that includes a first pod body defining a first, outer surface of the first nesting pod and a second, inner surface of the first nesting pod opposite to the first, outer surface, where the second, inner surface defines a first recessed cavity and a first recessed surface that is positioned between the first, outer surface and the second, inner surface, the first recessed cavity is configured to at least partially surround a first raised surface of a first protrusion of the plurality of protrusions of the first layer.

In some embodiments, each protrusion of the plurality of protrusions can be disposed separately from each other on the first surface of the fit adjustable liner layer.

In some embodiments, the plurality of protrusions can include an absorbent material.

In some embodiments, the first nesting pod can include a first flange extending from the second, inner surface of the first pod body, the first flange at least partially bordering the first pod body and selectively connected to the first surface of the first layer.

In some embodiments, a fastener can removably couple the first flange of the first nesting pod to the first surface of the fit adjustable liner.

In some embodiments, the fastener can include at least one of a hook and loop fastener, a snap connector, or a magnetic connector.

In some embodiments, the first pod body can include a first height; the at least one nesting pod can include a second nesting pod, the second nesting pod can include a second pod body defining a third, outer surface and a fourth, inner surface of the second pod body, wherein the fourth, inner surface defines a second recessed cavity in the second pod body, wherein the second pod body comprises a second height that is different from the first height.

In some embodiments, a distance between the first recessed surface and the first, outer surface of the first pod body can be different from a distance between the second recessed surface and the third, outer surface of the second pod body.

In some embodiments, the second nesting pod can be configured to at least partially surround the first raised surface of the first protrusion of the plurality of protrusions of the first layer.

In some embodiments, the second nesting pod can be configured to at least partially surround a second raised surface of a second protrusion of the plurality of protrusions of the first layer.

In some embodiments, the second nesting pod can be configured to fit at least partially over the first nesting pod.

Some aspects encompass a method including connecting a pad assembly to an inner surface of a helmet, the pad assembly can include a first layer that includes a first surface and a plurality of protrusions extending away from the first surface, each protrusion in the plurality of protrusions defining a raised surface; and disposing a second layer over the first layer, comprising disposing a nesting pod over a first raised surface of a first protrusion of the plurality of protrusions, wherein the nesting pod comprises a pod body defining a first, outer surface and a second, inner surface opposite to the outer surface, wherein the second surface defines a recessed cavity in the pod body.

These aspects can include one or more the following features.

In some embodiments, the nesting pod can include a flange extending from the pod body, the flange at least partially bordering the pod body, and the method can further include removably coupling the flange of the nesting pod to the first surface of the first layer.

In some embodiments, removably coupling the flange to the first surface can include connecting, with a selectively removable fastener, the flange to the first surface.

In some embodiments, connecting with the selectively removable fastener can include connecting with at least one of a hook and loop fastener, a snap connector, or a magnetic connector.

In some embodiments, the method can include removing the nesting pod from the first protrusion.

In some embodiments, the method can include disposing a second nesting pod over the first raised surface of the first protrusion, wherein the second nesting pod can include a second pod body defining a third, outer surface and a fourth, inner surface opposite to the third, outer surface, wherein the fourth surface defines a second recessed cavity in the second pod body.

In some embodiments, the pod body of the first-mentioned nesting pod can include a first thickness between the first, outer surface and the second, inner surface, the second pod body can include a second thickness between the third, outer surface and the fourth, inner surface of the second pod body, and the second thickness can be different than the first thickness.

In some aspects, a helmet system can include an outer shell; an absorption layer coupled to the outer shell, the absorption layer comprising a plurality of absorption structures, each absorption structure of the plurality of absorption structures extending from a first, outer end adjacent to the outer shell to a second, inner end, wherein the second inner ends of the plurality of absorption structures define an inner surface of the absorption layer; a load distribution plate coupled to the inner surface of the absorption layer, wherein the load distribution plate has a stiffness that is similar to a stiffness of the outer shell; and a liner coupled to the load distribution plate and configured to be positioned adjacent to a head of a wearer of the helmet system.

These aspects can include one or more the following features.

In some embodiments, the load distribution plate can include a plurality of load distribution plates.

In some embodiments, a first plurality of absorption structures within the plurality of absorption structures can extend from the outer shell to a first load distribution plate of the plurality of load distribution plates, and a second plurality of absorption structures within the plurality of absorption structures can extend from the outer shell to a second load distribution plate of the plurality of load distribution plates.

In some embodiments, the load distribution plate can directly connect to at least one absorption structure of the plurality of absorption structures.

In some embodiments, the at least one absorption structure can include a cover in the inner surface at the second, inner end of the at least one absorption structure, wherein the cover includes an opening; and the load distribution plate can include comprises at least one opening via which a fastener couples the inner load distribution plate to the least one absorption structure.

In some embodiments, each absorption structure of the plurality of absorption structures can be a hollow structure and can include a square, rectangular, or quadrilateral-shaped profile, wherein the square, rectangular, or quadrilateral-shaped profile at the first, outer end can be larger than the square, rectangular, or quadrilateral-shaped profile at the second, inner end of the absorption structure.

In some embodiments, each absorption structure in the plurality of absorption structures can include a tapered shape profile between the first outer end and the second inner end of the absorption structure.

In some aspects, an impact mitigation system for a helmet can include an impact mitigation layer comprising a plurality of absorption structures, each absorption structure of the plurality of absorption structures extending from a first, outer end to a second, inner end, where the second, inner ends of the plurality of absorption structures define an inner surface of the impact mitigation layer; and an inner load distribution plate connected to the inner surface of the impact mitigation layer, wherein the inner load distribution plate is thinner than the outer shell and has a stiffness that is similar to a stiffness of an outer shell of the helmet.

These aspects can include one or more the following features.

In some embodiments, the inner load distribution plate can include a plurality of load distribution plates.

In some embodiments, a first plurality of absorption structures within the plurality of absorption structures can extend from its first, outer ends to a first load distribution plate of the plurality of load distribution plates, and a second plurality of absorption structures within the plurality of absorption structures can extend from its first outer ends to a second load distribution plate of the plurality of load distribution plates.

In some embodiments, the inner load distribution plate can directly connect to at least one absorption structure of the plurality of absorption structures.

In some embodiments, the at least one absorption structure can include a cover in the inner surface at the second, inner end of the at least one absorption structure, wherein the cover includes an opening; and the inner load distribution plate can include at least one opening via which a fastener can couple the inner load distribution plate to the least one absorption structure.

In some embodiments, each absorption structure of the plurality of absorption structures can include a square, rectangular, or quadrilateral-shaped profile, wherein the square, rectangular, or quadrilateral-shaped profile at the first, outer end can be larger than the square, rectangular, or quadrilateral-shaped profile at the second, inner end of the absorption structure.

BRIEF DESCRIPTION OF THE DRAWINGS

Like reference numbers and designations in the various drawings indicate like elements.

DETAILED DESCRIPTION

Figure 1:
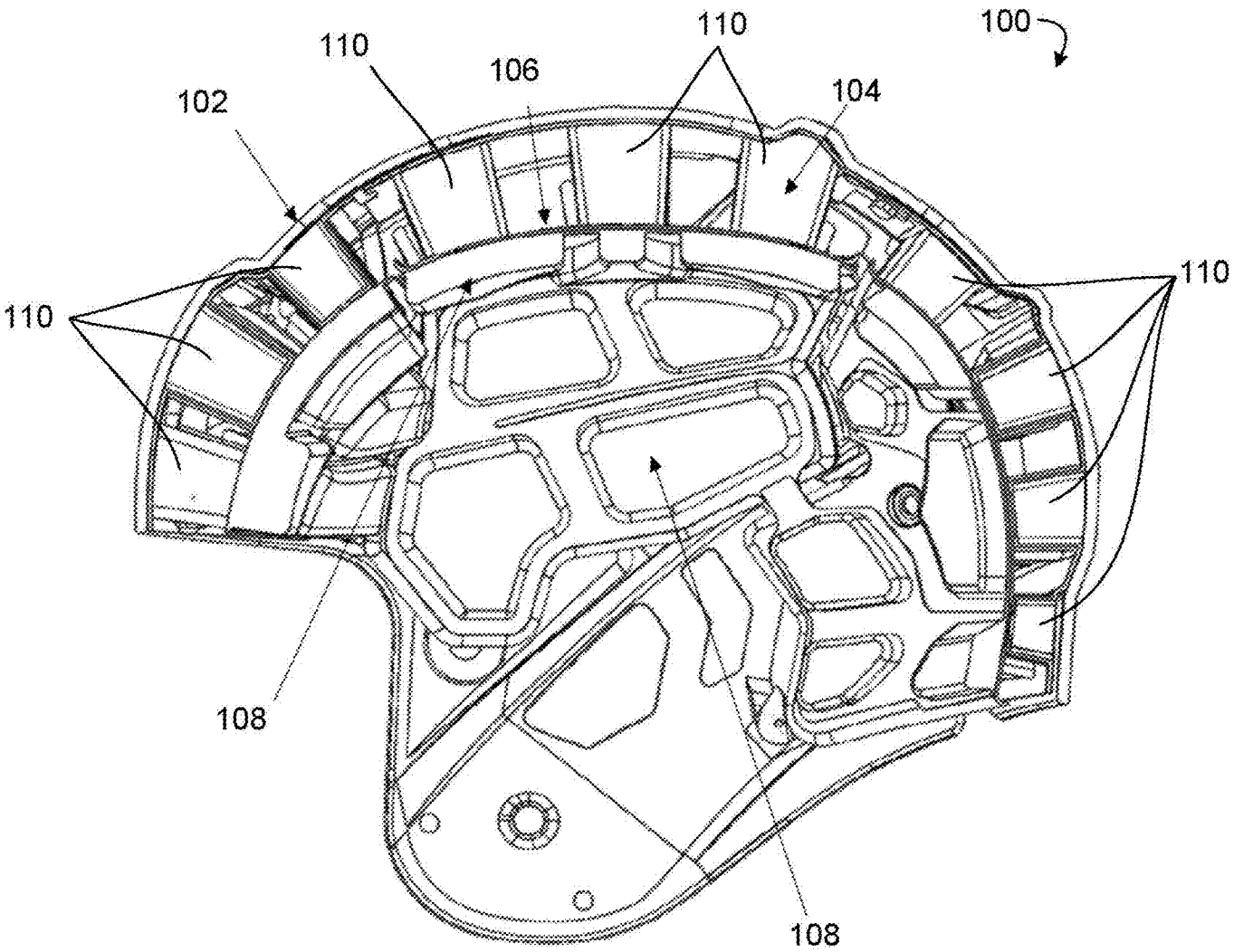
FIG. 1 is a cross-sectional side view of an example helmet system.

This disclosure describes helmet systems, such as helmets adapted for sports, that include one or more or all of an impact mitigation layer, a load distribution layer, a fit adjustable liner, or a combination of these layers. The one or more layers help protect a wearer of the helmet system from impacts by reducing, distributing, and/or or mitigating the effect of impacts to the helmet onto the wearer.

A helmet is typically designed to protect a wearer from impacts to the head. To mitigate impacts, a helmet can include an impact mitigating layer between the outer shell and the user's head. The impact mitigation layer is also referred to herein as an impact absorption layer or simply as an absorption layer. The absorption layer can be designed to slow accelerations in an impact to protect the head of the wearer. The stiffness, density, and design of the absorption layer (as well as the number of such layers that may be combined, e.g., in a vertical stack) can be adjusted to manage particular impact speeds that are likely to be experienced by the wearer's head upon impact. In some cases, the absorption layer can consistently and completely fill the space between the outer shell of the helmet and the head of a wearer of the helmet, as may be the case, e.g., when a foam is used for the absorption layer. However, in other cases, the absorption layer can be relatively less dense and include more open structures (e.g., lattice-base structures, column-based structures where the columns are laterally spaced apart from each other, or hollow polygonal structures with lateral walls formed between each filament positioned at vertices of the polygon).

The absorption layer does not typically provide adequate head comfort, which is why a comfort layer (also referred to herein as a comfort liner or simply as a liner) is typically provided between the head of the wearer and the absorption layer. The liner is generally softer relative to the absorption layer, and thus, the liner provides a more comfortable feel and fit (relative to the absorption layer) during normal use. Such a liner can also provide an impact mitigating response when low force impacts are applied to the helmet.

In some implementations, the absorption layer is thicker than the liner and is designed as such to absorb in whole or in part the impact force to the helmet, whereas the relative thinner and softer liner provides a comfort fit and can also mitigate low impact forces that may be received by the helmet.

However, when an absorption layer includes more open and less dense structures—as opposed to a layer that consistent fills the space between the shell and the liner or the head of the wearer—it is possible that a high velocity impact to the helmet is passed to the absorption structures, which in turn creates high pressure areas at particular points/areas defined by the underlying absorptions structures. Such high pressure points/areas are not suitable mitigated by a relatively softer liner, which then results in the high pressure points/areas being felt by the head of the helmet wearer.

Liners also facilitate fitting of the helmet to the head of the wearer. However, different people have different head sizes and dimensions, and thus, the fit of a helmet with certain liner elements (as well as other internal components) for a particular wearer may not be the same as a fit of another wearer.

The techniques described herein overcome the above-described issues and other issues apparent to those of skilled in the art. In some implementations, a helmet can include one or more impact management assemblies (also referred to herein as impact attenuation system or assembly) coupled to a surface of the helmet (e.g., inner surface of outer shell of helmet). For example, an impact management assembly can include one or more of an absorption layer, a load distribution plate coupled to the absorption layer, and a liner coupled to the inner load distribution plate. In some embodiments, the helmet can include multiple impact management assemblies, with each individual assembly coupled to an inner surface of the helmet's outer shell at different regions (e.g., crown, front, rear, left side, and right side). Alternatively, the helmet can include a single impact management assembly that is coupled to and covers all or a substantial portion of the inner surface of the helmet's outer shell.

In some embodiments, the absorption layer in an impact management assembly includes impact mitigating structures (e.g., a hollow polygonal structure with filaments that are connected by lateral walls between each adjacent pair of filaments, lattice based structures) that extend from a first distal end at a first surface (e.g., the end coupled to and proximal to the outer shell) to a second distal end at a second surface (e.g., the end coupled to and proximal to the inner load distribution plate). In some embodiments, other types of impact absorbing structures can be deployed in the absorption layer such as, e.g., straight filaments extending between the top and bottom surfaces of the absorption layer, raised dome structures extending between the top and bottom surfaces of the absorption layer, and foam or other rate sensitive materials filling a space between the top and bottom surfaces of the absorption layer.

As described above, open or less dense impact absorption structures (that do not consistently fill a space between the helmet's inner and outer surfaces) can result in high pressure areas/points. However, when such structures/absorption layer are coupled to the inner load distribution plate, the load or high pressure is more uniformly distributed across the surface of the load distribution plate. In some implementations, the load distribution plate has a stiffness that is similar to or less than the stiffness of the outer shell of the helmet, and/or can be thinner than (i.e., less thick than) the outer shell of the helmet. This enables use of less materials and by extension more resource efficient manufacturing of the distribution plates while still achieving the benefits of uniform load distribution.

In some implementations, the impact absorption structures change in width as they extend from a first distal end at a first surface (e.g., the end coupled to and proximal to the outer shell) to a second distal end at a second surface (e.g., the end coupled to and proximal to the inner load distribution plate). In other words, in some implementations, the impact absorbing structures taper (or narrow in width) as they extend from the outer shell toward the inner load distribution plate. Alternatively, in some implementations, the impact absorbing structures taper (or narrow in width) in the other direction—i.e., as they extend from the inner load distribution plate to the outer shell.

In some implementations, the helmet can include a layered padding assembly coupled to an inner surface of the helmet (e.g., an inner surface of the helmet's outer shell, an inner surface of an absorption layer, or the inner load distribution plate). In some implementations, the layered padding assembly can be a liner, the fit of which can be adjusted (thus referred to as fit adjustable liner), e.g., by virtue of addition of one or more layers). Alternatively, the layered padding system can be implemented as part of the absorption layer or can represent a layer of the absorption layer together with a layer of a liner or another absorption layer.

In some implementations, the layered padding assembly can include a base surface or a first surface (e.g., a base liner surface of the fit-adjustable liner). The base/first surface can include multiple laterally spaced apart protrusions formed therein, with each protrusion defining a raised surface (that is raised relative to the base/first surface). Each of the raised surfaces can be filled with an absorbent material (e.g., foam), air, and/or another impact attenuating structure or material (e.g., lattice-based structures, another molded or engineered structure).

A second layer including one or more pad or impact attenuating elements (also referred to herein as nesting pods/elements; in the case of a liner, these can be referred to as nesting fit pods, fit pods) can be fit and positioned over the raised surfaces and the underlying protrusions. The pad elements can be made of the same or different material as the material used in the protrusions defined in the base liner surface, can have the same or different durometer, and/or can have different thicknesses.

For example, in the case where nesting pods are provided as part of a fit-adjustable liner, the nesting fit pods can be fit over one or more of the raised surfaces formed in the base liner surface, for example, to create a thicker or taller raised surface for a more snug fit against a wearer's head (as compared with a fit created by virtue of only raised surface(s) formed in the base liner surface or just the base liner surface without any raised surfaces therein). For ease of description and conciseness, the descriptions in FIGS. 1-14 are provided in the context of providing nesting pods as part of a fit-adjustable liner with a base liner surface to which the nesting pods are coupled. However, one skilled in the art will appreciate that the same structural and operational details described with reference to a fit-adjustable liner are also applicable to another layer in the padding assembly, which may include the liner, the absorption layer (and/or absorption structures within such a layer), or any combination of these internal components of the helmet.

In some implementations, each nesting pod extends from a first, outer surface to a second, inner surface, with a recessed cavity formed in the bottom surface and a recessed inner surface formed between the first, outer surface and the second, inner surface of the nesting pod. The height of the recess/recessed cavity (i.e., the height from the bottom surface of the nesting pod to the recessed inner surface) is generally the same as the height of the raised surface formed/defined in the protrusions formed in the base surface (i.e., the height from the base surface to the top of the raised surface of the protrusion formed in the base surface), and the shape of the recessed cavity is the same as that of the raised surface formed in the base surface. This allows the nesting pod to align with and fit over a corresponding raised surface formed in the base/first surface, with the recessed inner surface of the nesting fit pod sitting atop the corresponding raised surface formed in the base surface when fitted together.

In some implementations, each nesting pod and the corresponding protrusion (and associated raised surface) is shaped so that the nesting pod can be fit over the protrusion/raised surface in a particular orientation. For example, the nesting pod and the protrusion (and associated raised surface) can have a particular hexagonal shape (as shown in FIGS. 8-11), such that the nesting pod can only be positioned over the protrusion (and associated raised surface) in a single orientation. This ensures a consistent fit and consistent impact response when the two are fitted together (as opposed to variability that might otherwise be introduced when a nesting pod is fitted over the protrusion/orientation in any orientation).

Although described above as a single nesting pod fitted over a single raised surface, some embodiments may include two (or more) integrally formed (but laterally displaced) nesting pods that sit atop two (or more) protrusions (and their associated raised surfaces) formed in the base surface. Additionally, where a single nesting pod is fitted over a first protrusion, and another nesting pod is fitted over a second, laterally displaced protrusion, an additional protrusion (and associated raised surface) (see element 1102 in FIG. 11) may be formed therebetween. This serves to provide an additional cushion or impact attenuation in the space between two raised surfaces over which nesting pods are provided.

In some implementations, each nesting pod has a flange formed at the second, inner surface of the nesting pod, such than when the nesting pod is fitted over a corresponding raised surface in the base surface, the recessed flange reaches down to and sits atop the base/first surface. Alternatively, the nesting pod can include tabs or other extensions that can be used to couple the nesting pod to the base/first surface in any appropriate manner, e.g., by wrapping around the base/first surface and coupling at one or more connection points on the other side of the base surface.

In some implementations, the flange (or tab) of the nesting pod can be removably fastened to the base/first surface using any appropriate, removable fastener, including, e.g., a hook-and-loop fastener, a snap connector, or a magnetic connector. For example, when using a hook-and-loop fastener, a first surface of a hook-and-loop fastener can be affixed (e.g., glued, stitched) to the flange or tab, and a second surface of the hook-and-loop fastener can be affixed (e.g., glued, stitched) to the corresponding surface of the base surface. This allows the nesting pod to be removably fastened to the base/first surface.

In some implementations, the nesting pods can have varying heights and thicknesses, such that layered padding assembly can be modified to have different heights and thickness at different locations/regions of the helmet. Thus, the nesting pod-based liner has the advantage of enabling a more customized fit for a head of a wearer of the helmet. For example, if a certain portion of the helmet is loose or not snuggly in contact with a wearer's head, the nesting pod(s) in that region of the helmet can be replaced with taller/thicker nesting pod(s). On the other hand, if a certain portion of the helmet is too tight or snuggly affixed to a wearer's head, the nesting fit pod(s) in that region of the helmet can be replaced with thinner/shorter nesting fit pod(s) (or be removed altogether such that the raised surface defined in the base liner surface is then directly in contact with the wearer's head). The modifiable fit of the fit-adjustable liner thus allows the same helmet to be used to achieve different customized fits (e.g., a first, looser fit for a practice setting and a second, more snug fit for a gameplay setting) for the same wearer or to achieve different, customized fits for different wearers (e.g., the same helmet can be worn and customized in fit for different wearers).

Additionally, in some implementations, each of the nesting pods can have the same general shape such that each nesting pod can be coupled to any similarly-shaped raised surface formed in the base surface. This allows interchangeable coupling of different nesting pods to any of the different raised surfaces formed in the base/first surface. This in turn reduces manufacturing costs that would otherwise result from creation of different shaped nesting pods for different regions of the helmet. However, although the nesting pods and the corresponding raised surfaces formed in the base/first surface can have the same shape, in some implementations, different shapes of raised surfaces can be formed in the base surface, and similarly shaped nesting pods corresponding to those differing shapes of the raised surfaces can also be provided.

In some implementations, a helmet system can be provided and can include a helmet that has impact management assemblies coupled to a surface (e.g., an inner surface) of the helmet. In such implementations, the liner can be the fit-adjustable liner described above, with multiple sets of nesting pods of different sizes (thicknesses and heights) provided therewith. A wearer of the helmet can then use the different nesting pods to customize a fit that is desirable to the wearer. In this manner, the helmet system described herein reduces the number of parts for fitting the helmet while enabling and simplifying custom fitting of the helmet to a wearer's head.

These and additional details and benefits of the helmet system are described below with reference to FIGS. 1-14.

FIG. 1 is a cross-sectional side view of an example helmet system 100 that can form a helmet to be worn on a head of a wearer, such as during a sporting activity (e.g., football, lacrosse, etc.). The example helmet system 100 includes an outer shell 102 and one or more impact management assemblies. When multiple assemblies are provided, each such assembly is separately coupled to a different region of the outer shell 102.

As shown in FIG. 1, each impact management assembly includes an absorption layer 104 coupled to the outer shell 102, a load distribution plate 106 (also referred to herein as inner load distribution plate 106) coupled to an inner surface of the absorption layer 104, and a liner 108 coupled to the load distribution plate 106. Alternatively, each impact management assembly includes a load distribution plate 106 (also referred to herein as inner load distribution plate 106) coupled to an inner surface of an absorption layer 104 (which is independent coupled to the inner surface of the outer shell of the helmet), and a liner 108 coupled to the load distribution plate 106. In the present disclosure, the absorption layer 104 forms all or a portion of an impact mitigating layer of the helmet system 100, and reacts to impacts against the helmet with a dynamic, partially collapsible and reformable support between the outer shell 102 and the load distribution plate 106.

The outer shell 102 can be manufactured from a rigid or substantially rigid material, such as polyethylene, nylon, polycarbonate materials, acrylonitrile butadiene styrene (ABS), polyester resin with fiberglass, thermosetting plastics, and/or other rigid thermoplastic materials. Alternatively, the outer shell 102 can be manufactured from a relatively deformable material, such as polyurethane and/or high-density polyethylene, where such material allows some flexibility and/or local deformation of the outer shell 102 (and/or the absorption layer 104 attached to the inner surface of the outer shell 102) upon impact, but provide sufficient rigidity to prevent breakage or damage to the outer shell 102. The outer shell 102 can be formed of a continuous, single shell, or a multi-piece assembly (e.g., a two-piece shell assembly of a front shell and a back shell) that conforms to and surrounds the head of the wearer.

The absorption layer 104 can be directly coupled to the outer shell 102, and includes multiple absorption structures 110 formed at a first, outer end of the absorption layer adjacent to the outer shell, with each absorption structure separately extending from the first, outer end of the absorption layer 104 adjacent to the outer shell 102 to a second, inner end of the absorption layer 104. The absorption structures 110 are partially compressible in response to an impact force, and can return to a neutral position (as show in FIG. 1) when the impact force no longer acts on the absorption structures 110. As shown in the example of FIG. 1, each absorption structure 110 is a quadrilateral formed of four filaments, with each adjacent pair of filaments connected using lateral walls. The ends of the absorption structures 110 formed at the second, inner ends of the absorption layer 104 define an inner surface of the absorption layer 104, closest to a wearer of the example helmet shell 100.

In some implementations (and as shown in example of FIG. 1), each absorption structure 110 can include a tapered profile between its outer end and its inner end. In some examples, the tapered shape profile includes a square, rectangular, or another quadrilateral shape at an outer end of the absorption structure 110, and a relatively smaller square, rectangular, or another quadrilateral shape at an inner end of the absorption structure 110. The shape profiles can vary, and the absorption structures 110 are described in greater detail later.

In some implementations, the absorption structures 110 in the absorption layer 104 can define an opening at the first, outer end of the absorption layer 104. In some implementations, the absorption structures 110 in the absorption layer 104 can either define an opening at the second, inner end of the absorption layer 104 or can include a cover with a central aperture/opening formed therein.

The load distribution plate 106 in each assembly can be coupled to the inner surface of the absorption layer 104, such as one or more inner surfaces defined by the absorption structures 110. For example, in implementations where some of the absorption structures include a cover with an opening/aperture formed therein, the load distribution plate 106 can be coupled to those absorption structures 110 using fasteners that attach to the load distribution plate 106 and terminate within the openings/apertures formed in the covers of certain absorption structures.

The liner 108 in each impact management assembly can be coupled to the load distribution plate(s) 106, and can be positioned adjacent to a head of a wearer of the example helmet system 100. The liner 108 can include one or more pads or cushioning elements (multiple pads shown in FIG. 1) or other cushioning structures meant to contact and cushion a head of a wearer of the helmet system 100.

The load distribution plate(s) 106 can be made of a rigid material that can nevertheless conform or flexibly bend into a curved formation. The load distribution plate 106 provides a relatively uniform surface to which multiple absorption structures 110 are coupled, and which distributes impact forces received and mitigated by the multiple absorption structures 110 across a greater surface area of the inner load distribution plate 106, for example, instead of focusing impact forces received by the multiple absorption structures 110 and transferring the same directly to the liner and/or the head of the wearer.

In some implementations, the load distribution plate 106 can be formed such that it is thinner than the outer shell (i.e., has a thickness that is less than the thickness of the outer shell). In some implementations, the load distribution plate 106 can be made of a stiffness that is similar to (i.e., within −50% to +100% of) the stiffness of the outer shell 102. The relative thickness and stiffness allows the load distribution plate(s) to be more easily manufactured, at a lesser cost (owing to reduce manufacturing needs and materials) and provides a lighter helmet (by weight; compared to conventional helmets) that nevertheless achieves the improved function of uniform load distribution.

In some implementations, the load distribution plate 106 can include multiple load distribution plates, disposed over different zones/regions of the example helmet structure 100. For example, the load distribution plate 106 can include a front plate that is disposed over a front zone of the example helmet system 100, a left plate that is disposed over a left lateral side of the example helmet system 100, a right plate that is disposed over a right lateral side of the example helmet system 100, a rear plate that is disposed over a rear zone of the example helmet structure 100, a top plate that is disposed over a top crown zone of the example helmet structure 100, a combination of these plates, or additional plates. One skilled in the art will appreciate that, compared to a single plate that spans all or a portion of the helmet, smaller plates are easier to manufacture and ship, and are flexibly connectible to the helmet.

Alternatively, in some embodiments, the load distribution plate 106 can be a single load distribution plate that spans and covers all or a portion of the surface defined by the multiple absorption structures dispersed throughout the helmet. In some embodiments, the helmet can include a single uniform absorption layer coupled to the inner surface of the outer shell and spanning all or a substantial portion of the inner surface (as opposed to separate absorption layer formed and provided in different zones of the helmet). In such embodiments, the inner load distribution plate 108 can either be a single plate that cover all or a portion of the surface area provided by the absorption structures 110 of the absorption layer, or multiple load distribution plates that are provided over different zones of the helmet (as described in the preceding paragraph) and coupled to the absorption structures of the absorption layer(s) within these respective zones.

In some embodiments, the helmet can include a multiple laterally-spaced absorption layers coupled to the inner surface of the outer shell and spanning all or a substantial portion of the inner surface (as opposed to a separate absorption layer formed and provided in different zones of the helmet). In such embodiments, the load distribution plate 106 can either be a single load distribution plate that covers all or a portion of the surface area provided by the different absorption layers, or multiple load distribution plates that are provided over different zones of the helmet (as described above) and coupled to the absorption structures within these respective zones.

The one or more load distribution plates of the load distribution plate 100 enable dispersion impact forces received by multiple adsorption structures 110 across a greater, more uniform surface area of the inner load distribution plate 108 (as opposed to the smaller surface area provided by each of the individual absorption structures), while also separating or focusing impact forces into particular zones of the example helmet structure 110. The inner load distribution plate 106 is described in greater detail later.

In embodiments where multiple pad assemblies are provided for installation within different zones of the helmet, one or more of such assemblies are coupled to an inner surface of the helmet (e.g., the surface defined by the impact absorption layer 104 or the inner surface of the outer shell 102). In some examples, the impact absorption layer 104 can include a base/first layer to which one or more absorption structures are attached (and which extend in a direction toward the interior of the helmet), and the base/first layer can an opposing surface to which a fastener (e.g., a T-nut) is coupled and which can be used to secure the absorption layer 104 to one or more opening(s) in the outer shell 102. Other fasteners such as screws, rivets, among others, can be used to achieve this coupling as well.

As explained above, the absorption layer 104 can be formed as a single layer or multiple laterally spaced apart layers, where the absorption structures 110 in each layer are all connected to a common base layer that is then connected to the outer shell 102. Alternatively, in some implementations, the absorption layer 104 can be formed of multiple layers (e.g., two or more vertically stacked layers) of absorption structures that are coupled to each other, and then the entire absorption layer 104 can be coupled to the inner surface of the outer shell 102 (in a manner described above).

Multiple inner load distribution plates 106 can be coupled to the inner surface of the respectively absorption layers (i.e., the surface opposite from the surface coupled to the outer shell 102). Alternatively, a single load distribution plate can be coupled to (using any appropriate fastener, e.g., plastic rivets, one-way fasteners, among others) and can span/cover all or a portion of the inner surface of the various absorption layers 104 (or alternatively, a single absorption layer 104 as may be the case in some embodiments).

Multiple liners 108 (or a single liner 108) can be coupled to the load distribution plate(s) 106. In some implementations, the outer surface of a liner 108 can include snap posts that engage with openings formed in the inner load distribution plate 106 to removably couple the liner(s) 108 to the inner load distribution plate(s) 106. Other types of fasteners can also be used, e.g., hook-and-loop fasteners, among others, to achieve this coupling.

Figure 2:
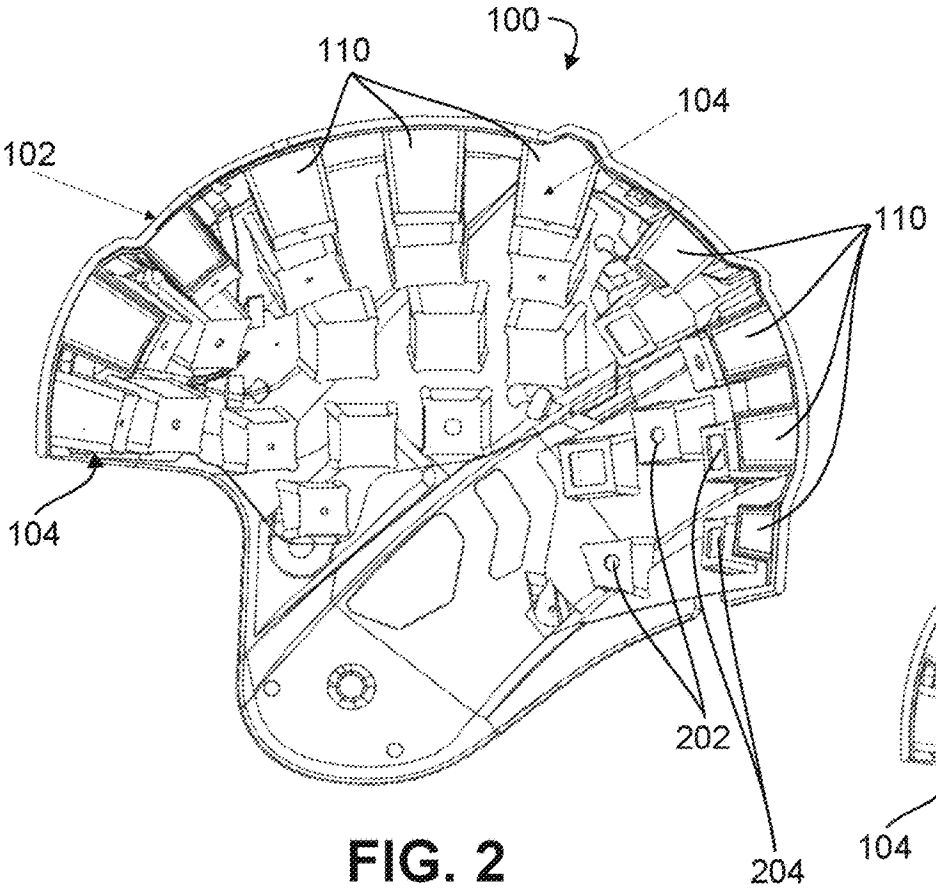
FIG. 2 is a cross-sectional partial side view of the example helmet system of FIG. 1.
Figure 3:
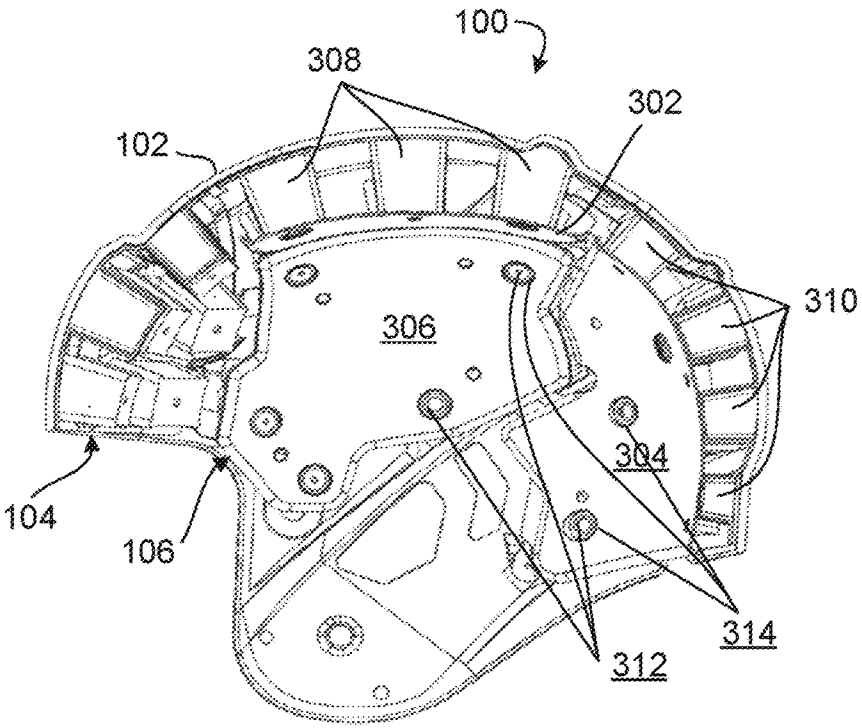
FIG. 3 is another cross-sectional partial side view of the example helmet system of FIG. 1.

FIG. 2 is a cross-sectional partial side view of the example helmet system 100 of FIG. 1, but with the inner load distribution plate(s) 106 and liner(s) 108 removed. FIG. 3 is another cross-sectional partial side view of the example helmet system 100 of FIG. 1, with the liner(s) 108 removed.

The partial views of the example helmet system 100 of FIGS. 2 and 3 depict an example structure between the outer shell 102 and the liner 108. For example, as depicted in FIG. 3, load distribution plate 106 includes multiple load distribution plates that are shown as assembled at different portions on the absorption layer 104. For example, the load distribution plate 106 includes a first plate 302, a second plate 304, and a third plate 306, where the first plate 302, second plate 304, and third plate 306 are arranged over separate absorption structures 110 that cover a top portion, a rear portion, and a right side portion, respectively, of the helmet system 100. Although the load distribution plate 106 of FIG. 3 is depicted as including three plates, the inner load distribution plate 106 can include more or fewer plates than those depicted in the example helmet system 100 shown in FIG. 3.

The load distribution plate 106 (or plates) can be formed from a rigid or substantially rigid material, such as polyethylene, nylon, polycarbonate materials, acrylonitrile butadiene styrene (ABS), polyester resin with fiberglass, thermosetting plastics, and/or other rigid thermoplastic materials. Alternatively, the load distribution plate 106 (or plates) can be manufactured from a relatively deformable material, such as polyurethane and/or high-density polyethylene, where such material allows some flexibility and/or local deformation of the inner load distribution plate(s) 106 upon impact, but provide a degree of rigidity that avoids breakage or damage to the load distribution plate(s) 106. As described above, in some implementations, the load distribution plate 106 can be made of a stiffness that is similar to (i.e., within −50% to +100% of) the stiffness of the outer shell 102. In some cases, the outer shell can have a stiffness, e.g., of 2100 mPA, of 800 mPA. The relative thickness and stiffness allows the load distribution plate(s) to be more easily manufactured, at a lesser cost (owing to reduce manufacturing needs and materials) and provides a lighter helmet (by weight; compared to conventional helmets) that nevertheless achieves the improved function of uniform load distribution.

In some implementations, such as referring to the example helmet system 100 of FIG. 3, a first set 308 of the absorption structures 110 extend from the outer shell 102 to the first load distribution plate 302 (and are coupled thereto), a second set 310 of the absorption structures 110 extend from the outer shell 102 to the second load distribution plate 304 (and are coupled thereto), and a third set (not shown) of the absorption structures 110 extend from the outer shell 102 to the third load distribution plate 306 (and are coupled thereto).

As shown in FIG. 2, each of the impact absorption structures 110 include an inner surface (i.e., the surface opposing the surface coupled to the outer shell 102) that either has an opening 204 spanning nearly the entire inner surface other than the portion defining the perimeter/border of the impact absorption structure 110, or has a cover defining a central opening or aperture 202. Alternatively, in some implementations, each impact absorption structure 110 can include only the cover defining a central opening or aperture 202 at the inner surface of the respective absorption structures 110.

As described previously, each of the load distribution plates 106 are coupled to absorption structures 110 in the impact absorption layer 104. In some implementations, and as shown in FIG. 3, the coupling is achieved via a fastener 314 (e.g., a one-way zip tie, plastic rivets) that is secured via openings 314 in the load distribution plates 106 and the corresponding openings/apertures 202 formed in certain absorption structures 110. In some implementations, the fastener 314 rigidly fastens the inner load distribution plate 106 to the absorption structures 110, such that after the fastening, the load distribution plate 106 and the respective absorption structures 110 are not separable without damaging or otherwise breaking the fastener. Alternatively, the fastener 314 can provide a removable coupling between the load distribution plate 106 and the absorption structures, such that the load distribution plate 106 can be readily removed from the respective absorption structures 110 without damaging or otherwise breaking the fastener 314.

The shape and profile of the absorption structures 110 can vary. In some implementations, one or more or all of the absorption structures 110 includes a rectangular or square profile (or another quadrilateral or polygonal shape with four or more sides), wherein the rectangular or square profile at the first, outer end (i.e., closest to the outer shell 102) is larger than the rectangular or square profile at the second, inner end of the absorption structure 110—thereby forming a tapered absorption structure 110 that tapers as it extends from the first outer end to the second, inner end. In the example helmet system 100 of FIGS. 1-3, the absorption structures 110 are hollow, and include continuous lateral walled surfaces between the rectangular/square profile at outer end and the rectangular/square profile at its inner end. The tapered profiles of the absorption structures 110 provide an elastic response to impact forces against the example helmet structure 100 that mitigates and/or distributes impact forces between the outer shell 102 and load distribution plate(s) 106, and further provides for an even distribution of impact at both the outer and inner surfaces of the absorption structures 110.

The absorption structures 110 can be formed of a semi-flexible elastic material, such as rubber, polyurethane, and/or high-density polyethylene, where such material allows flexibility and/or local deformation of the absorption structures 110 upon impact, but provide an elastic response that biases the absorption structures 110 to return to its initial orientation and disposition, as depicted in FIGS. 1-3.

The liner 108 is formed of one panel or multiple panels disposed over the inner surface(s) of the inner load distribution plate(s) 106. Each panel of the liner 108 can include one or more pads protruding inward (i.e., toward a wearer) from a base/first surface (i.e., the base liner surface of the liner 108). In the example helmet system 100 of FIG. 1, the liner 108 includes five liner panels, with each panel including multiple raised surfaces with pads or other absorbent materials disposed therein (hereinafter referred to as protruding pads or simply protrusions). The protrusions can be disposed separately from each other and extend toward an interior space of the example helmet system 100. Each panel of the liner 108 acts as padding, cushioning, or other type of buffer between the impact mitigating structures (e.g., absorption layer 106 and/or inner load distribution plate 106) and the wearer's head, and can take a variety of other forms and shapes than those depicted in the example helmet system 100 of FIG. 1.

Figure 4:
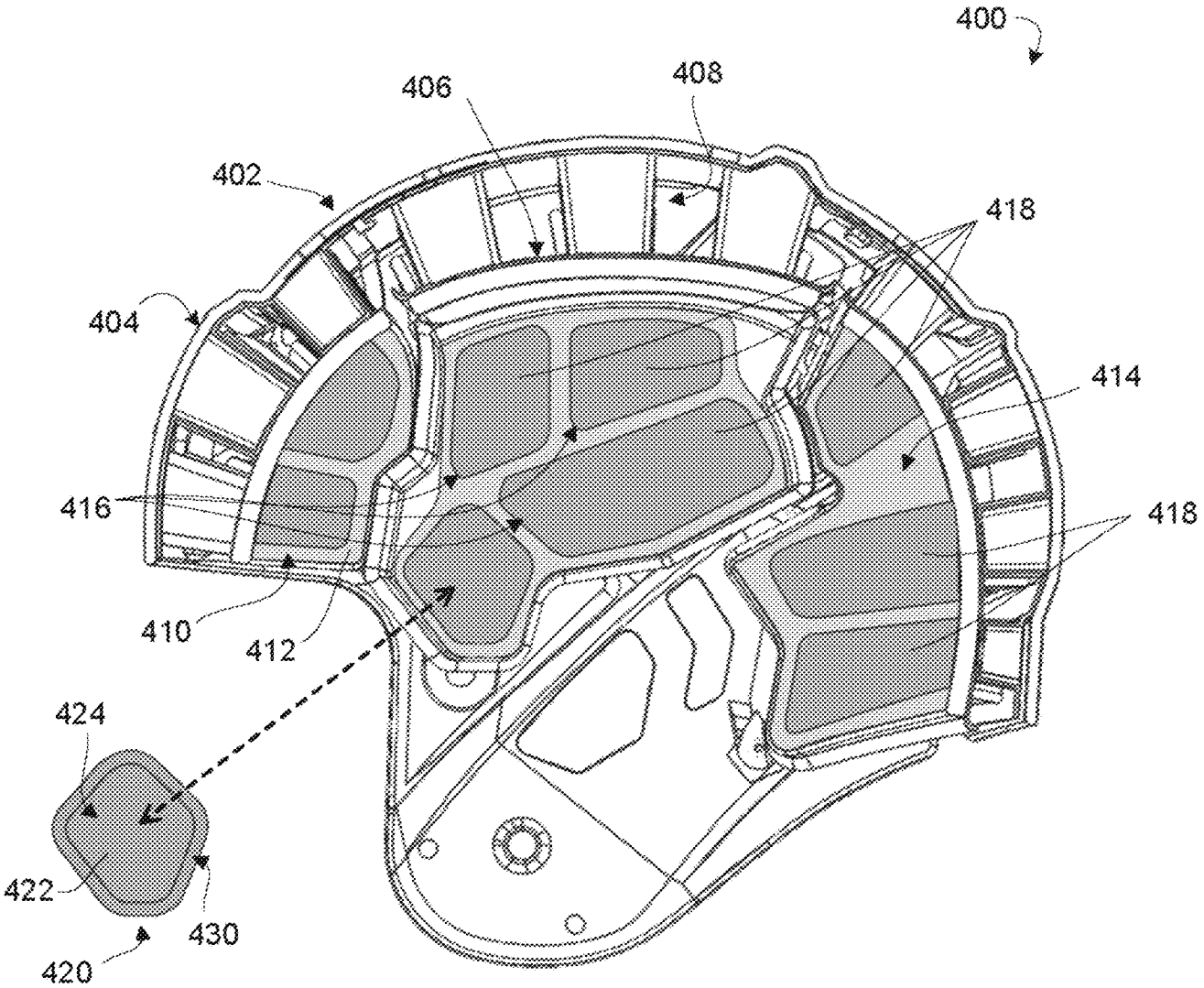
FIG. 4 is a cross-sectional side view of an example helmet system including an example pad assembly.

FIG. 4 is a cross-sectional side view of an example helmet system 400 including a pad assembly 410. The example helmet system 400 includes a helmet shell 402 that defines an outer surface 404 and an inner surface 406. The helmet system 400 also includes an impact mitigation layer 408 disposed between the outer surface 404 (which can be, e.g., the inner surface of the outer shell 102 as described and depicted with reference to FIG. 1) and the inner surface 406 (which can be, e.g., the inner load distribution plate 106 described and depicted with reference to FIGS. 1-3 or alternatively, the outer surface of an inner shell).

In some implementations, the helmet 402 may not include the inner load distribution plate(s) 106 or an inner shell, in which case the liner 108 (and the associated panels and components, which are further described below) can be directly coupled to the impact absorption structures. In some implementations, the helmet 402 may not include the load distribution plate(s) 106, an inner shell, or even the impact absorption layer 104. In such instances, the liner 108 can be directly coupled to the inner surface of the outer shell 102, and can serve, in whole or in part, as the impact absorption layer 104 as well as the liner 108. Alternatively, in some implementations, the helmet may only include a multi-layer assembly that can serve dual functions—one layer with a first stiffness that mitigates high velocity impacts and a second layer with a second stiffness (that is less than the first stiffness) that is more akin to a liner and provides impact mitigation for lower velocity impacts. As one skilled in the art will appreciate, however, the structure of the helmet shell 402, the impact mitigation layer 408, and/or the liners can vary and the multi-layer construction of the helmet can be adjusted to achieve different objectives and design considerations.

In some implementations, the example helmet system 400 of FIG. 4 can include the same or similar features as the example helmet system 100 of FIG. 1. For example, the example helmet system 400 of FIG. 4 can include one or more or all of the outer shell 102, absorption layer 104, load distribution plate 106, and liner 108 of the example helmet system 100 of FIG. 1. In some examples, the outer surface 404 of the example helmet system 400 can include the outer shell 102 of the example helmet system 100 of FIG. 1, the inner surface 406 of the example helmet system 400 can include the inner load distribution plate 106 of the example helmet system 100 of FIG. 1, and the impact mitigation layer 408 of the example helmet system 400 can include the absorption layer 104 of the example helmet system 100 of FIG. 1.

The pad assembly 410 of the example helmet system 400 couples to the inner surface 406 of the helmet shell 402, and includes a fit adjustable liner 412 and one or more nesting pods 420. The pad assembly 410 is fit adjustable to a wearer of the helmet system 400, in that one or more nesting pods 420 (of varying thicknesses, heights) can be readily coupled to the liner 412 at the raised surfaces/protruding pads formed therein, to provide a customizable fit and comfort desired by the wearer of the helmet.

The liner 412 couples to the inner surface 406 of the helmet shell 402, and includes a first surface 414 (defining the base liner surface) and multiple protrusions 416 extending away from the first surface 414 (e.g., inward toward the wearer of the example helmet system 400). Each protrusion 416 defines a raised surface 418, which can be substantially planar or substantially curved, such as to follow the contour of the head of a wearer of the example helmet system 400. The raised surface can be filled with an absorptive material (e.g., foam), air, or another impact attenuating structure or material. Each nesting pod 420 fits over at least one of the raised surfaces 418 of the protrusions 416, for example, to create an additional raised surface defined by the nesting pod 420 that is positioned more inward than the raised surface 418 of the protrusion 416 that the nesting pod 420 fits over. Each nesting pod 420 is selectively coupled to the liner 412, in that the nesting pods 420 can be coupled to the liner 412, readily removable from the liner 412, and readily re-coupled to the liner 412.

The material of the liner 412 can vary. In some implementations, the liner 412 be made of air, a flexible material (e.g., foam, rubber), or another cushioning material. In some instances, the protrusions 416 include foam or other compressible material (e.g., air, lattice-based structures), and/or can define an air pocket such that the protrusions 416 include foam, air, or a combination of these (or another suitable absorbent material). Each protrusion 416 can be disposed on the surface of the liner 412 separately from each other, for example, so that the protrusions are standalone on the liner 412.

Figure 5:
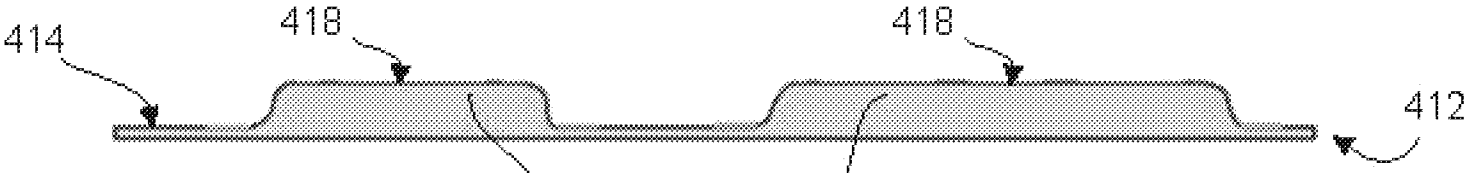
FIGS. 5-7 are cross-sectional side views of an example pad assembly that can be used in the example helmet system of FIG. 4.
Figure 6:
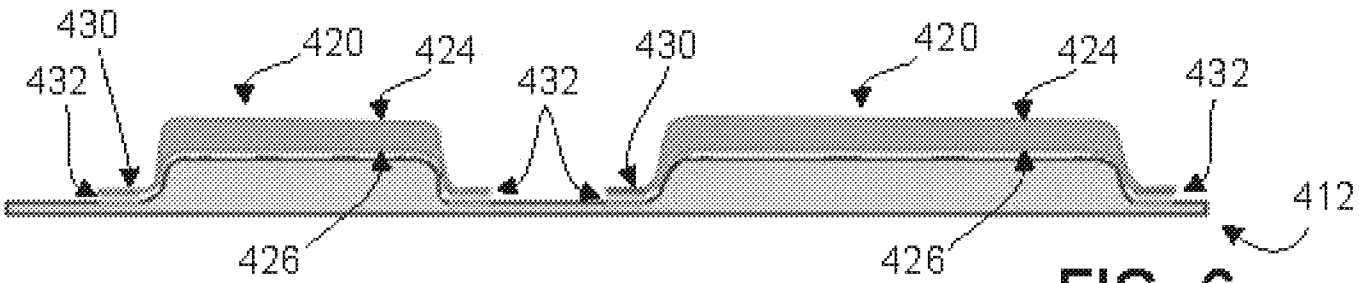
Figure 7:
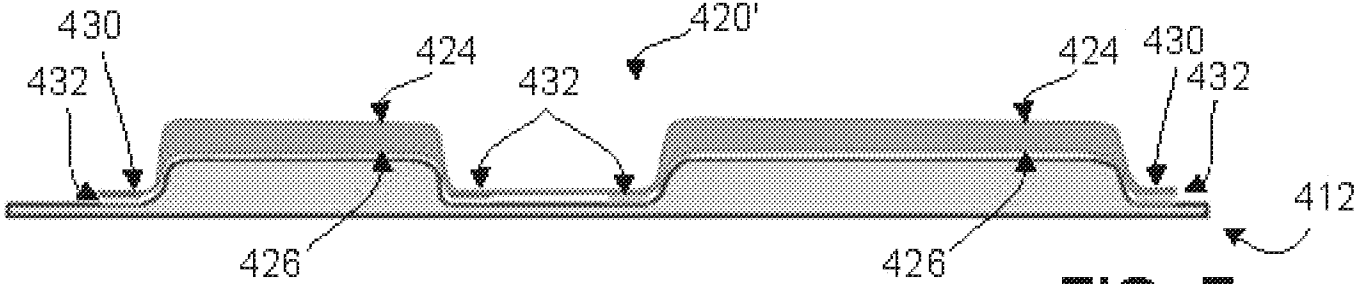
Figure 9:
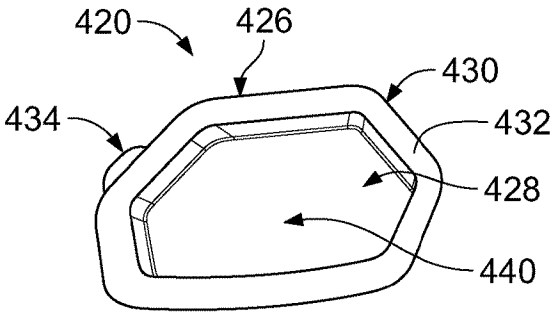
FIG. 9 is a rear perspective view of the example pod of FIG. 8.
Figure 8:
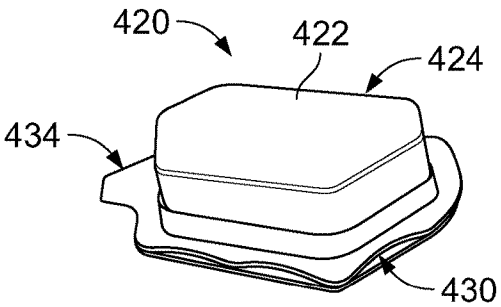
FIG. 8 is a perspective view of an example pod.

FIGS. 5-7 are cross-sectional side views of a portion of the example pad assembly 410, and FIGS. 8 and 9 are a perspective view and a rear perspective view, respectively, of an example nesting pod 420 of the pad assembly 410 of FIG. 4. For example, FIG. 6 depicts two nesting pods 420 disposed over two protrusions 416 of the liner 412 portion, and FIG. 7 depicts an example dual nesting pod 420' that is disposed over the two protrusions 416 of the liner 412 portion. Referring to FIGS. 4-9, the nesting pod 420 (or example dual nesting pod 420') includes a pod body 422 defining an outer surface 424 and an inner surface 426 of the pod body 422 opposite to the outer surface 424. The inner surface 426 (as further shown in FIG. 9) defines a recessed cavity 428 in the pod body 422 that partially or completely surrounds a raised surface 418 of one (or more) of the protrusions 416 formed in the base liner surface of the liner 412.

In some implementations, the nesting pod 420 includes a flange 430 extending outwardly from the inner surface 426 of the pod body 422. The flange 430 partially or completely borders the pod body 422, and can selectively connect, or removably connect, to the first surface 414 of the liner 412. In some examples, the nesting pod 420 includes a fastening mechanism 432 to selectively and removably couple the flange 430 of the nesting pod 420 to the first surface 414 of the fit adjustable liner 412. The fastening mechanism 432 can include a hook and loop fastener (as depicted in FIG. 9), a snap connector, a magnetic connector, or another type of fastener that removably connects the nesting pod 420 to the liner 412, where the fastening mechanism 432 can also be disconnected so that the nesting pod 420 can be separated from the liner 412. In some instances, the example nesting pod 420 includes a further extension 434 of material extending from the flange 430, where the extension 434 acts as a tab for a user to grab and remove the nesting pod 420 from a selectively connected position on the liner 412.

In some implementations, each nesting pod and base/first surface assembly can be interconnected with other such assemblies (e.g., use tabs or other extensions that couple to tabs (e.g., using hook-and-loop fasteners) or other extensions of other assemblies) to achieve a larger interconnected assembly of nesting pods and base/first surfaces that then couple to an inner surface of the helmet.

The material of the nesting pod 420 can vary. In some implementations, the nesting pod 420 includes a flexible material, such as foam, rubber, or other impact attenuating material (e.g., a lattice-based structure). In some instances, nesting pod 420 can include an absorbent material, for example, to absorb or wick moisture from the wearer of the helmet system 400 with the nesting pod 420 connected.

The shape and profile of the nesting pod 420 can vary, for example, to substantially or exactly match a shape of a protrusion 416 of the liner 412 in order to cover one or more protrusions 416 of the liner 412. In some implementations, the pod body 422 can include an overall height (e.g., a distance from inner surface 426 to the outer surface 424) that is greater than the height of the protrusions 416 (e.g., a distance from the first surface 414 of the liner 412 and the raised surface 418 of the protrusion 416), for example, to provide a surface from the liner 412 that is raised further than the raised surface 418 of the protrusion 416. In such implementations, the depth of the recessed cavity (i.e., the distance from the inner surface 426 of the pod body 420 to the recessed surface 440 defined in the recessed cavity, where the recessed surface 440 is disposed between the inner surface 426 and the outer surface 424) is the same as the height of the protrusion 416, such that when the nesting pod 420 is fitted over a protrusion 416, the recessed surface 440 sits atop the raised surface defined by the protrusion 416.

In some implementations, a second nesting pod with a similar structure as the example nesting pod 420 has an overall height that is greater than the overall height of the example nesting pod 420. The second nesting pod can partially or completely surround a raised surface 418 of a protrusion 416 and selectively and removably connect to the liner 412, or alternatively can partially or completely surround a raised surface of another nesting pod and selectively connect to the liner 412 or the flange of the intermediate nesting pod. As such, the nesting pods can be stacked on top of each other to adjust a position of a raised surface against the head of a wearer of the example helmet system 400, or several nesting pods can have different overall heights to provide a variety of raised surface positions based on the particular nesting pod selected by a wearer.

In some instances, the pod body 422 includes a material thickness between the outer surface 424 and the recessed surface 440. And because the nesting pods can be provided with different overall heights and thicknesses, one skilled in the art will appreciate that different nesting pods can have different material thicknesses between the outer surface 424 and the recessed surface 440. Thus, a second nesting pod with a similar shape and profile as a first nesting pod 420 (shown in FIGS. 8-9) can include a pod body with a second thickness that is greater than the first thickness of the first nesting pod 420. The second pod can thus provide a raised surface that resides further from the first surface 414 of the liner 412 (e.g., closer to a wearer of the example helmet system 400) than the raised surface of the pod body 422 of the first nesting pod 420.

The example nesting pod 420 is shaped to cover a single raised surface 418 of one protrusion 416 of the liner 412. However, a nesting pod can be adapted to cover more than one raised surface 418 of more than one protrusion 416, such as two or more protrusions 416.

Figure 10:
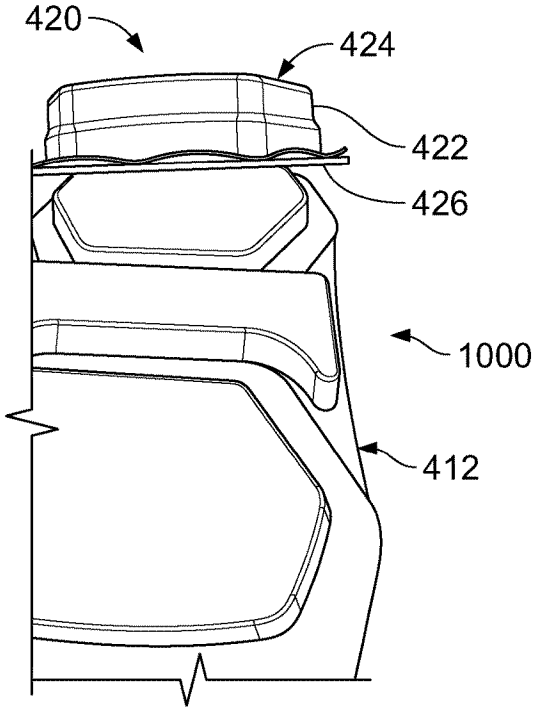
FIG. 10 is a perspective view of an example pad assembly.

FIG. 10 is a perspective view of an example pad assembly 1000, including an example liner portion 412 (similar to the liner portion 412 of FIGS. 5-7) and an example nesting pod 420 (similar to the example nesting pod 420 of FIGS. 4-7). The raised surface 418 of the protrusions 416 of the liner portion 412 have a first protruding height, and the nesting pod 420 has a protruding height from its first surface 426 (to the second, outer surface 424) that is greater than the first protruding height of the protrusions 416. As such, when the nesting pod 420 is fit over a protrusion 416 and connected to the liner base 414 (e.g., using a hook-and-loop fastener), the raised surface of the nesting pod 420 is closer to the wearer than the raised surface 418 of the protrusion 416 that the nesting pod 420 is surrounding and positioned over.

In the example helmet system 400 of FIG. 4, one or more or all of the protrusions 416 of the liner 412 can be fitted with one or more nesting pods 420. The nesting pods 420 can be selectively attached and removed from the liner 412 to create a customized fit of the example helmet system 400 to a wearer of the helmet system 400. For example, the example helmet system 400 of FIG. 4 can be fit with nesting pods 420 over some or all of the raised surfaces 418 of the protrusions 416 of the liner 412. After being placed on a wearer's head, if there are locations where one or more nesting pods 420 provide too tight of a fit for the wearer, the respective nesting pod(s) 420 can be removed from the liner 412 in these identified tight areas, and in some instances, replaced with thinner/smaller nesting pod(s) or not replaced with any nesting pods such that the raised surface 418 of the protrusion 416 provide the only surface directly adjacent to the head of the wearer.

In another example, the example helmet system 400 of FIG. 4 can be fit without any nesting pods 420. After being placed on the wearer's head, if there are locations where one or more raised surfaces 418 are too loose for the wearer, one or more nesting pods 420 can be fit over the raised surfaces 418 of the liner 412 in those identified looser areas. Because the nesting pods 420 can be easily connected or removed from the example helmet system 400, the example helmet system 400 is readily and easily customizable to various head sizes and various wearers of the helmet.

In some implementations, referring to the example helmet system 100 of FIG. 1 and example helmet system 400 of FIG. 4, one or more liner panels forming all or a portion of the liner 412, or one or more load distribution plates forming the load distribution plate 106 can be readily removable, and the liner panels and/or nesting pods on these liner panels and/or load distribution plates can be customizable and readily removable and installable on a helmet, for example, to fit individual wearers or multiple wearers of the helmet.

Figure 11:
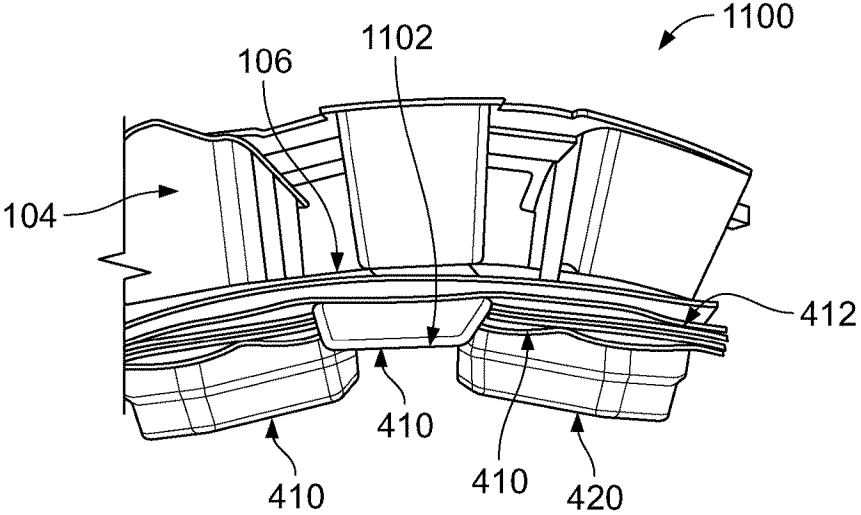
FIG. 11 is a side view of a portion of an example helmet assembly, including an absorption layer, a load distribution plate, a liner, and a pod assembly.

For example, FIG. 11 is a side view of a helmet panel portion 1100 of an example helmet assembly, which can be assembled onto a helmet. The helmet panel portion 1100 includes an absorption layer 104, a load distribution plate 106, a liner 108/410, and a pod assembly 420, similar to the adsorption layer 104 and load distribution plate 106 of the example helmet system 100 of FIG. 1 and the pad assembly 410 (including liner 412 and nesting pods 420) of the example helmet system 400 of FIG. 4.

Figure 12:
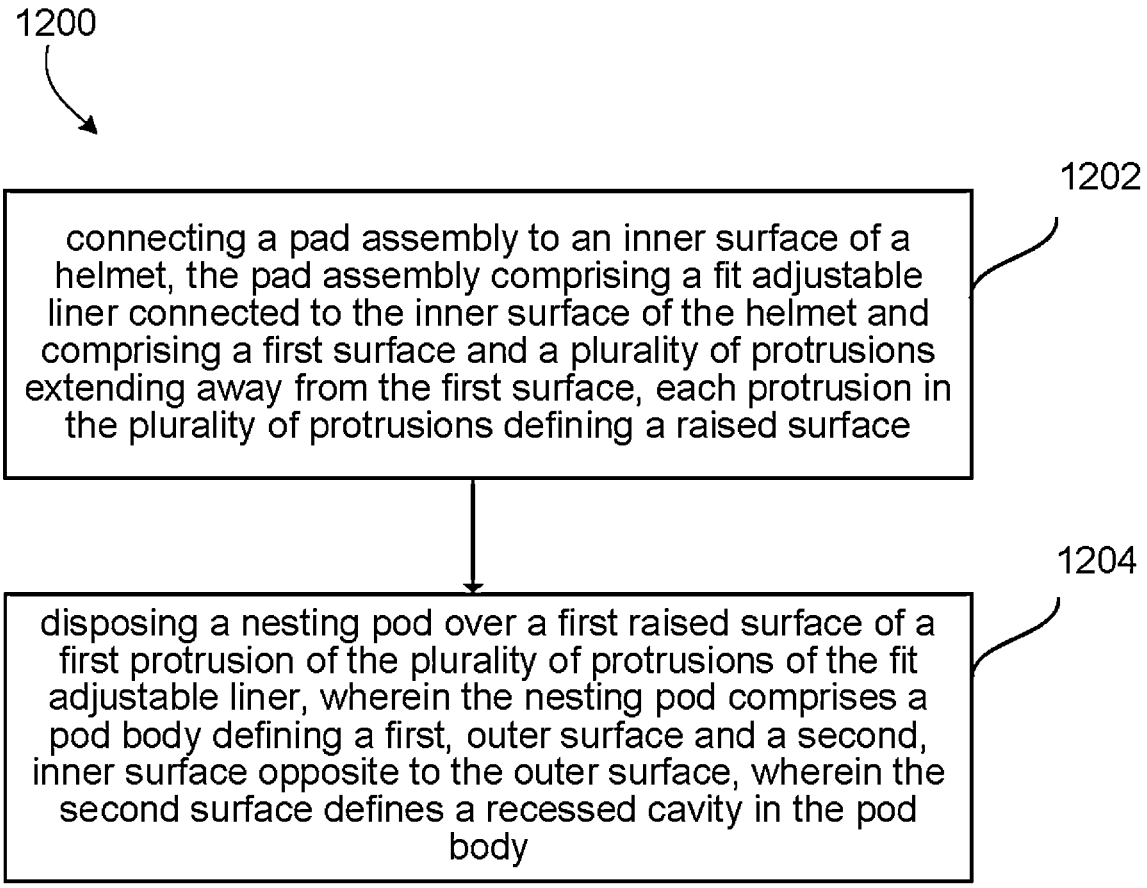
FIG. 12 is a flowchart describing an example method for connecting a pad assembly to a helmet.

FIG. 12 is a flowchart describing an example method for connecting a pad assembly to a helmet.

At 1202, a pad assembly is coupled to an inner surface of a helmet, where the pad assembly can include a first layer, which in the context of a liner is a fit adjustable liner. The first layer is coupled to the inner surface of the helmet or an impact mitigation layer, and includes a first surface and a plurality of protrusions extending away from the first surface. Each protrusion in the plurality of protrusions defines a raised surface.

At 1204, a second layer including at least one nesting pod is disposed over a first raised surface of a first protrusion of the plurality of protrusions of the first layer, where the nesting pod includes a pod body defining a first, outer surface and a second, inner surface opposite to the outer surface. The second, inner surface defines a recessed cavity in the pod body. In some instances, the nesting pod includes a flange extending from the second, inner surface of the pod body, where the flange at least partially borders the pod body.

In some implementations, disposing the nesting pod over the first raised surface includes selectively connecting the flange of the nesting pod to the first surface of the fit adjustable liner. Selectively connecting the flange to the first surface can include connecting, with a selectively removable fastening mechanism, the flange to the first surface. The connecting with a selectively removable fastening mechanism can include connecting with at least one of a hook and loop fastener, a snap connector, or a magnetic connector.

In some implementations, the nesting pod is removed from the first protrusion. In certain implementations, a second nesting pod is disposed over the first raised surface of the first protrusion, where the second nesting pod includes a second pod body defining a third, outer surface, and a fourth, inner surface opposite to the third, outer surface, and the fourth surface defines a second recessed cavity in the second pod body. The pod body of the first-mentioned nesting pod can include a first thickness between the first, outer surface and the second, inner surface, and the second pod body can include a second thickness between the third, outer surface and the fourth, inner surface of the second pod body. The second thickness can be different than the first thickness.

Figure 13:
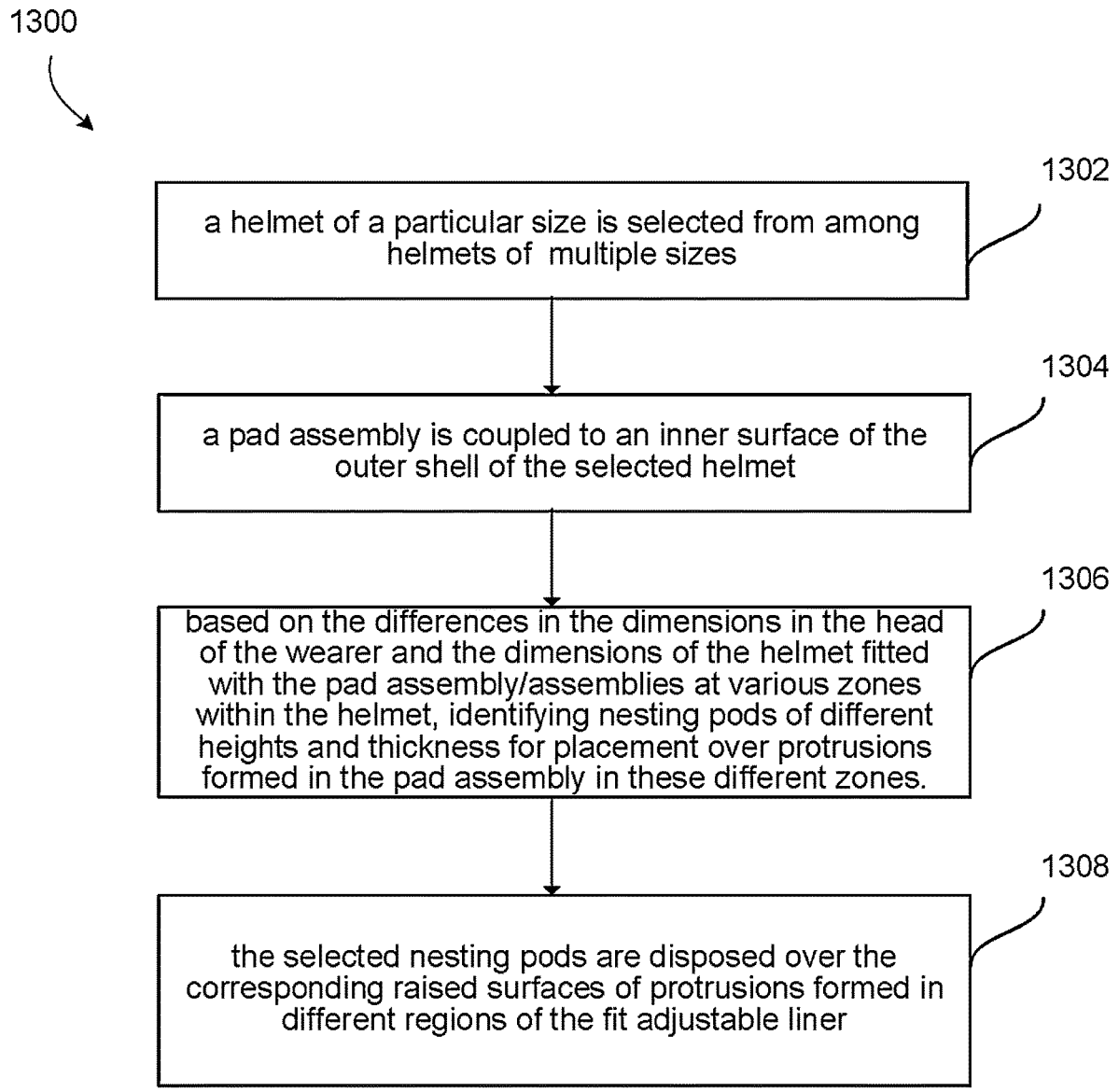
FIG. 13 is a flowchart describing an example method for customizing a fit of the helmet to a head of a wearer of the helmet.

FIG. 13 is a flowchart describing an example method for customizing a fit of the helmet to a head of a wearer of the helmet.

At 1302, a helmet of a particular size is selected from among helmets of multiple sizes. For example, a particular helmet can have an outer shell with different sizes, e.g., small, medium, large, and extra-large. In some implementations, a helmet of a particular size can be selected based on a measurement of a wearer's head. For example, the head of a wearer can be scanned (e.g., using a three-dimensional scanner or another head circumference measuring device) to determine dimensions of the head and compared to the different dimensions of the helmet outer shell of different sizes. If the dimensions of the wearer's head are the same as or greater than that of the outer shell of a helmet of a particular size, then that particular helmet size is determined to be of an incorrect size for the wearer. On the other hand, if the dimensions of the wearer's head are less than the combination of (1) the dimensions of the outer shell of a helmet of a particular size and (2) threshold dimensions/volume that accounts for the volume/dimensions expected to be filled by the impact absorbing structures, the inner surfaces, and/or base liner, then that particular helmet size is determined to be the appropriate size for the wearer's head and is selected for further processing as described below.

At 1304, a pad assembly is coupled to an inner surface of the outer shell of the selected helmet, where the pad assembly includes a fit adjustable liner connected to the inner surface of the helmet and including a first surface and a plurality of protrusions extending away from the first surface. Each protrusion in the plurality of protrusions defines a raised surface. Moreover, the inner surface can be the inner surface of the outer shell, the surface defined by any impact absorbing layer coupled to the inner surface of the outer shell, or the surface defined by an inner load distribution plate that is coupled to the outer shell (via an impact absorbing layer disposed between the outer shell and the inner load distribution plate).

At 1306, based on the differences in the dimensions in the head of the wearer and the dimensions of the helmet fitted with the pad assembly/assemblies at various zones within the helmet (which can be determined by physical measurements or by computer simulations of the same), identifying nesting pods of different heights and thickness for placement over protrusions formed in the pad assembly in these different zones. The particular nesting pods are selected such that, when coupled to the liner, the raised surfaces of the nesting pods contact the head of the wearer and provide a snug fit of the wearer's head within the helmet.

In some implementations, a computer or another appropriate data processing apparatus with at least one processor and at least one memory storing programming instructions can be used for performing these operations. For example, the programming instructions, when executed by the at least one processor, can perform the operations of (1) computing the dimensions of the wearer's head based on the head scan data received from the head scanning apparatus, (2) determining (e.g., from data stored in memory) dimensions for outer shells of helmets of different sizes, (3) determining the dimensions of the inner surface defined by the dimensions of the outer shell of the selected helmet and the additional structures (e.g., impact absorbing layer, inner load distribution plate, and pad assembly) that can be fitted in the helmet (as described with reference to operation 1304), and (4) determining, within different regions of the helmet, a difference/differences in the dimensions between the head of the wearer and the combined dimensions of the inner surface (as determined in the immediately preceding step). Using the difference/differences in the dimensions between the head of the wearer and the combined dimensions of the inner surface, the operations (upon execution of programming instructions by at least one processor) can include selecting nesting pods of particular thickness and heights (from among a plurality of nesting fit pods of different thicknesses and heights) that is/are the same as or less than that of the determined difference/differences. In this manner, nesting pods are selected that provide a customized fit of the helmet to the head of a wearer.

At 1308 (and similar to operation 1204 in FIG. 12), the selected nesting pods are disposed over the corresponding raised surfaces of protrusions formed in different regions of the first layer. In some instances, the nesting pod includes a flange extending from the second, inner surface of the pod body, where the flange at least partially borders the pod body. In some implementations, disposing the nesting pods over the various raised surfaces includes selectively connecting the flange of each nesting pod to the corresponding base/first surface of the first layer. Selectively connecting the flange to the first surface can include connecting, with a selectively removable fastener, the flange to the base/first layer/surface.

Figure 14:
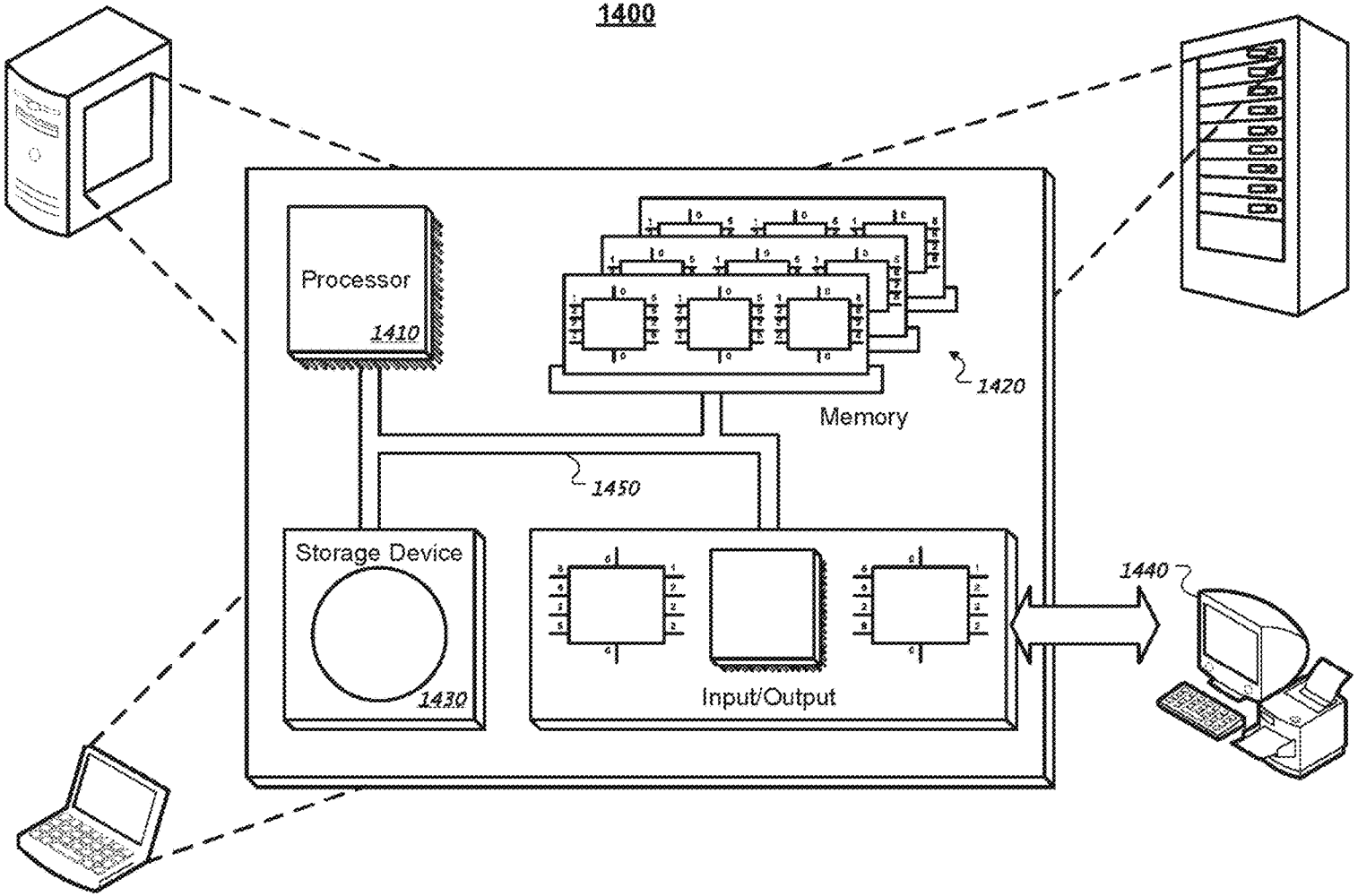
FIG. 14 is a schematic diagram of an exemplary generic computing system.

FIG. 14 illustrates a schematic diagram of an exemplary generic computing system that can be used to perform the computing operations described in this specification according to some implementations. The system 1400 is intended to represent various forms of digital computers, such as laptops, desktops, workstations, personal digital assistants, servers, blade servers, mainframes, mobile devices and other appropriate computers. The components shown here, their connections and relationships, and their functions, are exemplary only, and do not limit implementations of the inventions described and/or claimed in this document.

The system 1400 includes a processor 1410, a memory 1420, a storage device 1430, and an input/output device 1440. Each of the components 1410, 1420, 1430, and 1440 are interconnected using a system bus 1450. The processor 1410 may be enabled for processing instructions for execution within the system 1400. In one implementation, the processor 1410 is a single-threaded processor. In another implementation, the processor 1410 is a multi-threaded processor. The processor 1410 may be enabled for processing instructions stored in the memory 1420 or on the storage device 1430 to display graphical information for a user interface on the input/output device 1440.

The memory 1420 stores information within the system 1400. In one implementation, the memory 1420 is a computer-readable medium. In one implementation, the memory 1420 is a volatile memory unit. In another implementation, the memory 1420 is a non-volatile memory unit.

The storage device 1430 may be enabled for providing mass storage for the system 800. In one implementation, the storage device 1430 is a computer-readable medium. In various different implementations, the storage device 1430 may be a floppy disk device, a hard disk device, an optical disk device, or a tape device.

The input/output device 1440 provides input/output operations for the system 800. In one implementation, the input/output device 1440 includes a keyboard and/or pointing device. In another implementation, the input/output device 1440 includes a display unit for displaying graphical user interfaces.

Implementations of the subject matter described in this specification can be implemented in digital electronic circuitry, suitable quantum circuitry or, more generally, quantum computational systems, in tangibly-embodied digital computer software or firmware, in digital and/or quantum computer hardware, including the structures disclosed in this specification and their structural equivalents, or in combinations of one or more of them.

Implementations of the digital and/or quantum subject matter described in this specification can be implemented as one or more digital computer programs, i.e., one or more modules of digital computer program instructions encoded on a tangible non-transitory storage medium for execution by, or to control the operation of, data processing apparatus. The digital computer storage medium can be a machine-readable storage device, a machine-readable storage substrate, a random or serial access memory device, one or more qubits, or a combination of one or more of them. Alternatively or in addition, the program instructions can be encoded on an artificially-generated propagated signal that is capable of encoding digital and/or quantum information, e.g., a machine-generated electrical, optical, or electromagnetic signal, that is generated to encode digital and/or quantum information for transmission to suitable receiver apparatus for execution by a data processing apparatus.

The term "data processing apparatus" refers to digital and/or quantum data processing hardware and encompasses all kinds of apparatus, devices, and machines for processing digital and/or quantum data, including by way of example a programmable digital processor, a programmable quantum processor, a digital computer, a quantum computer, multiple digital and quantum processors or computers, and combinations thereof. The apparatus can also be, or further include, special purpose logic circuitry, e.g., an FPGA (field programmable gate array), an ASIC (application-specific integrated circuit), or a quantum simulator, i.e., a quantum data processing apparatus that is designed to simulate or produce information about a specific quantum system. In particular, a quantum simulator is a special purpose quantum computer that does not have the capability to perform universal quantum computation. The apparatus can optionally include, in addition to hardware, code that creates an execution environment for digital and/or quantum computer programs, e.g., code that constitutes processor firmware, a protocol stack, a database management system, an operating system, or a combination of one or more of them.

The processes and logic flows described in this specification can be performed, at least in part, by one or more programmable digital computers, operating with one or more digital processors, as appropriate, executing one or more digital and/or quantum computer programs to perform functions by operating on input digital and quantum data and generating output. The processes and logic flows can also be performed by, and apparatus can also be implemented as, special purpose logic circuitry, e.g., an FPGA or an ASIC, or a quantum simulator, or by a combination of special purpose logic circuitry or quantum simulators and one or more programmed digital and/or quantum computers.

Some essential elements of a digital computer are a central processing unit for performing or executing instructions and one or more memory devices for storing instructions and digital and/or quantum data. The central processing unit and the memory can be supplemented by, or incorporated in, special purpose logic circuitry or quantum simulators. Generally, a digital and/or quantum computer will also include, or be operatively coupled to receive digital and/or quantum data from or transfer digital and/or quantum data to, or both, one or more mass storage devices for storing digital and/or quantum data, e.g., magnetic, magneto-optical disks, optical disks, or quantum systems suitable for storing quantum information. However, a digital and/or quantum computer need not have such devices.

Digital computer-readable media suitable for storing digital computer program instructions and digital data include all forms of non-volatile digital and/or quantum memory, media and memory devices, including by way of example semiconductor memory devices, e.g., EPROM, EEPROM, and flash memory devices; magnetic disks, e.g., internal hard disks or removable disks; magneto-optical disks; CD-ROM and DVD-ROM disks; and quantum systems, e.g., trapped atoms or electrons. It is understood that quantum memories are devices that can store quantum data for a long time with high fidelity and efficiency, e.g., light-matter interfaces where light is used for transmission and matter for storing and preserving the quantum features of quantum data such as superposition or quantum coherence.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a sub combination or variation of a subcombination.

Similarly, while operations are depicted in the drawings in a particular order, this should not be understood as requiring that such operations be performed in the particular order shown or in sequential order, or that all illustrated operations be performed, to achieve desirable results.

Particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A helmet comprising: an outer shell; and a pad assembly disposed inside the outer shell and comprising: a fit adjustable liner comprising a first surface and a plurality of protrusions extending away from the first surface to a respective height, the plurality of protrusions being resiliently compressible and respectively including a raised surface; and a liner pad element that is resiliently compressible, the liner pad element including a recessed cavity having a substantially matching shape and dimensions to one of the plurality of protrusions and having a depth that is substantially equal to the respective height of the one of the plurality of protrusions to nestingly receive and fit over the one of the plurality of protrusions.

2. The helmet of claim 1, wherein the plurality of protrusions comprises at least one of foam or air.

3. The helmet of claim 1, wherein the liner pad element comprises a first nesting pod, wherein the first nesting pod comprises:

a first pod body defining a first, outer surface and a second, inner surface opposite to the first, outer surface;

the second, inner surface defines a first recessed surface that defines the recessed cavity.

4. The helmet of claim 3, wherein the first nesting pod comprises a first flange extending from the first pod body, the first flange at least partially bordering the first pod body and removably coupled to the first surface of the fit adjustable liner.

5. The helmet of claim 4, further comprising a fastener that removably couples the first flange of the first nesting pod to the first surface of the fit adjustable liner.

6. The helmet of claim 5, wherein the fastener comprises at least one of a hook and loop fastener, a snap connector, or a magnetic connector.

7. The helmet of claim 3, wherein the first pod body comprises a first height measured between the first, outer surface and the first recessed surface;

wherein the liner pad element comprises a second nesting pod comprising a second pod body defining a third, outer surface and a fourth, inner surface of the second pod body, the second nesting pod supported on the fit adjustable liner.

8. The helmet of claim 7, wherein the fourth, inner surface defines a second recessed cavity configured to nestingly receive one of the plurality of protrusions, wherein the second pod body comprises a second height measured between the third, outer surface and the second recessed surface, the second height being different from the first height.

9. The helmet of claim 7, wherein the second nesting pod is configured to stack atop the first nesting pod.

10. The helmet of claim 7, wherein the second recessed cavity has a substantially matching shape to another one of the plurality of protrusions and has a second depth that is substantially equal to the respective height of the another one of the plurality of protrusions to nestingly receive the another one of the plurality of protrusions.

11. The helmet of claim 1, wherein the pad assembly comprises a plurality of regional pad assemblies, each regional pad assembly disposed within a particular region of the outer shell.

12. The helmet of claim 11, further comprising a plurality of load distribution plates within the outer shell, and wherein each regional pad assembly is coupled to a respective load distribution plate in the plurality of load distribution plates.

13. The helmet of claim 11, wherein the plurality of regional pad assemblies are interconnected to each other.

14. The helmet of claim 1, further comprising an impact mitigation layer within the outer shell, the pad assembly coupled to the impact mitigation layer.

15. A pad assembly for a helmet, comprising: a first layer comprising a first surface and a protrusion that is resiliently compressible, the protrusion extending away from the first surface to a height to define a raised surface; and a second layer comprising a nesting pod that is resiliently compressible, the nesting pod including a recessed cavity having a substantially matching shape and dimensions to the protrusion and having a depth that is substantially equal to the height to nestingly receive the protrusion and fit over the raised surface.

16. The pad assembly of claim 15, wherein the protrusion is one of a plurality of protrusions of the first layer, the plurality of protrusions being disposed separately from each other on the first surface of the first layer.

17. The pad assembly of claim 15, wherein the protrusion comprises an absorbent material.

18. The pad assembly of claim 15, wherein the nesting pod comprises a first flange removably connected to the first surface of the first layer.

19. The pad assembly of claim 18, further comprising a fastener that removably couples the first flange to the first surface.

20. The pad assembly of claim 19, wherein the fastener comprises at least one of a hook and loop fastener, a snap connector, or a magnetic connector.

21. The pad assembly of claim 15, wherein:

the nesting pod includes a first pod body defining a first, outer surface and a second, inner surface opposite to the first, outer surface, the first pod body including the recessed cavity the first pod body comprises a first height measured from the first, outer surface to the second, inner surface;

the second layer comprising another nesting pod comprising a second pod body defining a third, outer surface and a fourth, inner surface opposite to the third, outer surface, wherein the fourth, inner surface defines another recessed cavity in the second pod body, wherein the second pod body comprises a second height measured from the third, outer surface to the fourth, inner surface.

22. The pad assembly of claim 21, wherein the second height is different from the first height.

23. The pad assembly of claim 21, wherein the other nesting pod is configured to stack atop the nesting pod.

24. The pad assembly of claim 21, wherein the other nesting pod is configured to nestingly receive a second raised surface of a second protrusion of the first layer.

25. The pad assembly of claim 15, wherein the second layer further comprises another nesting pod configured to layer at least partially over the nesting pod.

* * * * *